United States Patent [19]

Naglowsky

[11] 4,133,272

[45] Jan. 9, 1979

[54] PICNIC TABLE

[76] Inventor: Michael Naglowsky, 2716 W. 16th St., Erie, Pa. 16505

[21] Appl. No.: 793,130

[22] Filed: May 2, 1977

Related U.S. Application Data

[63] Continuation of Ser. No. 658,287, Feb. 17, 1976, abandoned.

[51] Int. Cl.[2] ..... A47B 3/00

[52] U.S. Cl. ..... 108/132; 248/439

[58] Field of Search ..... 108/129, 131, 132; 248/439

[56] References Cited

U.S. PATENT DOCUMENTS

| | | | |
|---|---|---|---|
| 164,824 | 6/1875 | Fairchild | 108/131 |
| 184,508 | 11/1876 | Corban | 108/131 |
| 326,260 | 9/1885 | Allen | 108/132 |
| 382,937 | 5/1888 | Babcock | 108/132 |
| 902,245 | 10/1908 | Montgomery | 108/131 |
| 1,331,538 | 2/1920 | Spencer | 108/132 |
| 1,504,371 | 8/1924 | Ormerod | 108/132 |
| 1,585,598 | 5/1926 | Miner | 108/132 |
| 1,593,975 | 7/1926 | Karstens | 108/132 X |
| 1,605,963 | 11/1926 | Luger | 108/132 |
| 1,697,550 | 1/1929 | Amaducci | 108/132 |
| 2,874,013 | 2/1959 | Miller | 108/132 |

*Primary Examiner*—James C. Mitchell

*Attorney, Agent, or Firm*—Charles L. Lovercheck

[57] ABSTRACT

A table is disclosed that has flat topped legs hinged to the underside of the table top at one side of the legs so that the legs fold to position parallel with the underside of the table, and, when erect, the table rests on the upper ends of the legs. Depending end skirts are fixed to the underside of the table outboard of the legs and a bolt extends through each skirt and through each pair of legs. When folded, the legs of each pair terminate adjacent each other and are parallel with the underside of the table, and a turnbuckle is fixed to the underside of the table that rotates under the ends of the legs, holding them folded for transportation and storage.

1 Claim, 4 Drawing Figures

PICNIC TABLE

This is a continuation of application Ser. No. 658,287 filed Feb. 17, 1976, now abandoned.

OBJECTS OF THE INVENTION

It is an object of the invention to provide an improved folding table.

Another object of the invention is to provide a folding table that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWING

DETAILED DESCRIPTION OF THE DRAWING

Figure 1:
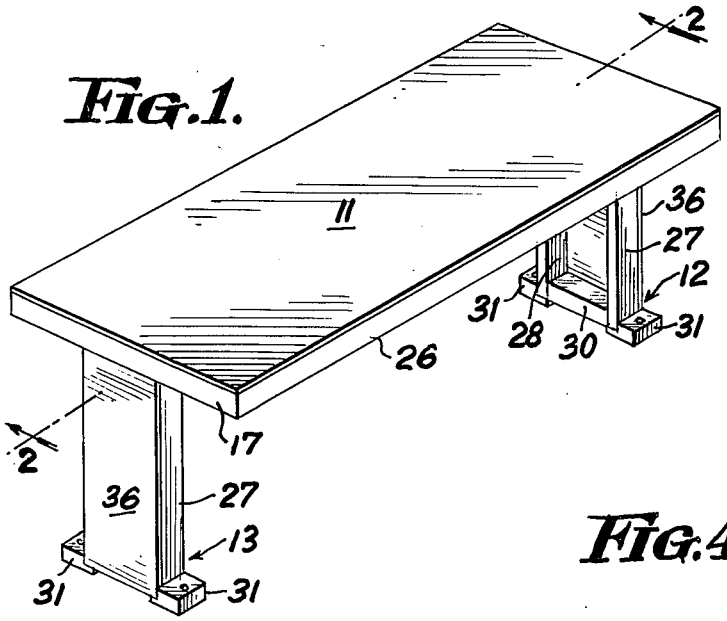
FIG. 1 is an isometric view of the table according to the invention.
Figure 4:
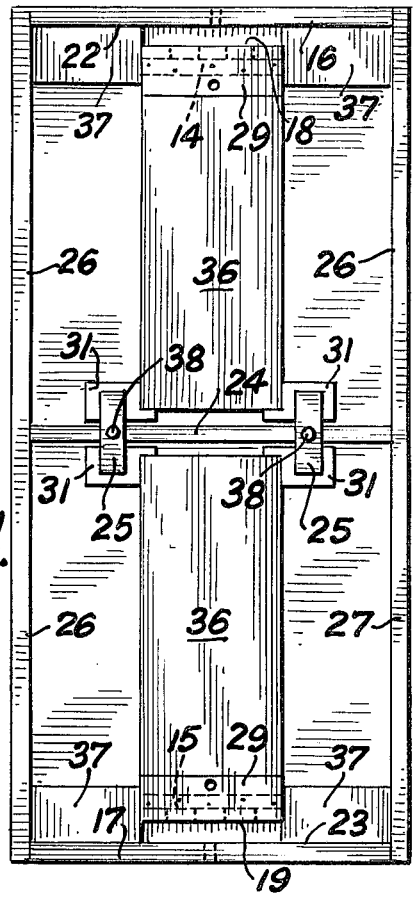
FIG. 4 is a bottom view of the table with the legs folded.

Now, with more particular reference to the drawing, the table 10 has a top 11 that may be rectangular and of the conventional type and may be made of hardwood, plastic or any other suitable material.

Figure 2:
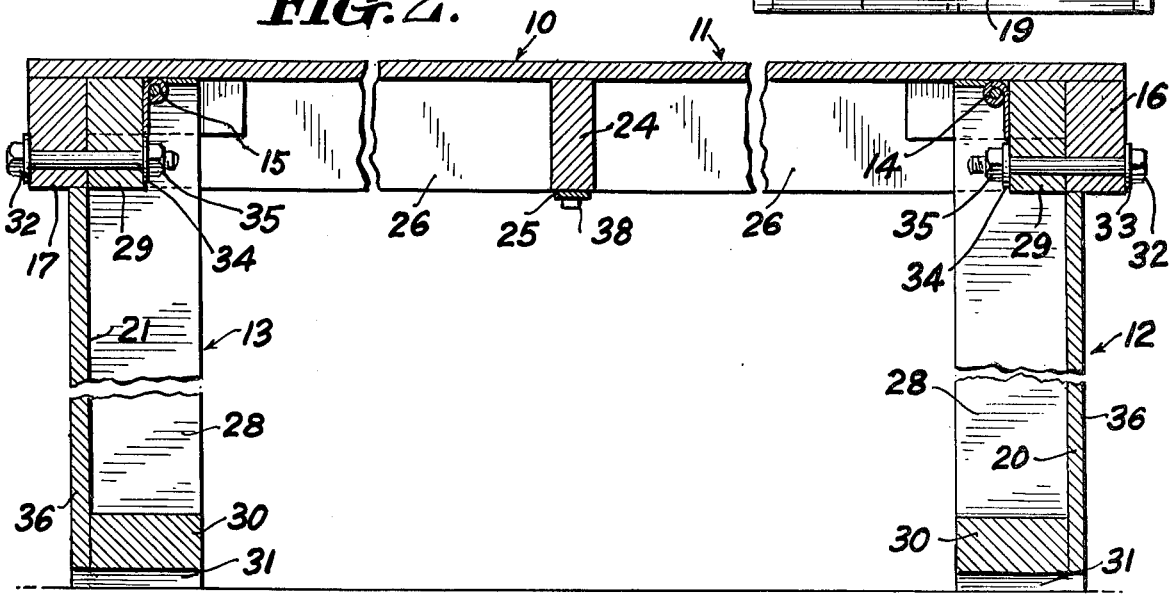
FIG. 2 is a longitudinal cross-sectional view of the table with legs erect.
Figure 3:
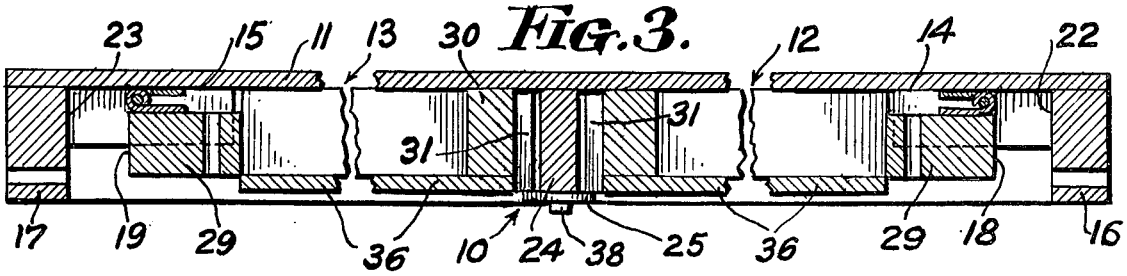
FIG. 3 is a cross-sectional view similar to FIG. 2 showing the legs folded.

The table has two pairs of legs 12 and 13 hinged to the underside of the table top by means of piano hinges 14 and 15. The legs have flat upper ends on which the table top rest when the legs are in erect position as shown in FIG. 2. The table top has the end skirts 16 and 17 fixed to the end of the underside of the table and side skirts 26 and 27 fixed to the underside of the table and disposed perpendicular to the end skirts 16 and 17.

The pairs of legs 12 and 13 are each made up of spaced legs 27 and 28 held in spaced relation at their upper end by cross member 29 which extends between the legs 27 an 28 at their upper end and the lower spacer 30 which is fixed at its end to the legs 27 and 28 at their lower end. Suitable feet 31 may be supported on the lower ends of the legs for protecting the floor on which the table may rest and these feet may extend outwardly for additional stability of the table.

The bolts 32 provided with washers 33 on the outer ends and washers 34 on the inner ends and are threaded to receive nuts 35 for holding the legs in erect position by clamping the top transverse member 29 to the skirts 16 and 17.

A sheet of material 36 is fixed to the outer end of each pair of the legs for holding them together so that the spaced legs 26 and 27 swing together as a unit. The upper ends of the legs have flat surface 18 and 19 on which the under side of the table rests when the legs are erect.

The outer sides 20 and 21 of the legs are parallel with the inner edges 22, 23 of the end skirts 16 and 17 when the legs are erect.

Spacers 37 are fixed to the underside of the table and the upper ends of the legs 27 and 28 swing between the spacers 37 when the table is erect thereby providing lateral stability. The intermediate cross member 24 is fixed to the underside of the table at the midpoint of the table and parallel to the cross member 29.

A lever 25 is provided having two ends and an intermediate part. The intermediate part is adapted to be pivoted at pivot 38 to the second cross member 24 which is attached to the table top. The lever 25 can be rotated from a position parallel to the cross member to a position perpendicular to the cross member whereby when the legs are in the folded position lever 25 will underlie the legs 36 thereby securing the legs in a folded position. One or more such levers 25 may be employed to hold the legs in folded position.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A table comprising, a table top made of a generally flat, rectangular plate-like member (11) forming a table top, two spaced end skirts (17), each end skirt (17) being fixed to the underside of the plate-like member (11) adjacent the ends thereof and extending downwardly therefrom, spaced side skirts (26), each said side skirt (26) being fixed to the underside of said plate-like member (11) and attached to said end skirts (17) at their ends, said side skirts (26) and said end skirts (17) together extending entirely around the periphery of said table top below the underside thereof, an intermediate cross member (24) fixed to the underside of said table and extending generally parallel to said end skirts (17) and being fixed to said side skirts at their midpoints, spaced legs (12, 13), said legs (12, 13) comprising space leg members (12, 13), a cross member (29) fixed to said leg members and extending therebetween at the upper ends of said leg members (12, 13), a lower spacer (30) fixed to the lower ends of said leg members and extending transversely thereof, a sheet of material (36) overlying each said leg members (12, 13), and said lower spacer (30) fixed thereto, said sheets (36) terminating at their upper end at the lower edge of said cross member (29) and said end skirts (17) resting on the upper edge of said sheets, piano hinges (15), each said piano hinge (15) being fixed to the underside of said table top (11) at a position spaced inwardly from said end skirts (17), bolts, said bolts (32) extending through each said end skirt (17) and through said cross members (29) whereby said end skirts and said cross members are held rigidly together and said legs are held in vertical rigid position perpendicular to said table top with the upper edge of said sheet resting on the lower edge of each said end skirts, said legs (12, 13) being swingable to a folded position wherein said leg members rest on the lower surface of said table top (11) with said sheets (36) generally parallel to said table top (11) and disposed above a plane passing through said end skirts, the lower spacer (30) being disposed in adjacent parallel relation to said intermediate cross member (24) and the outer side of said sheet (36) is flush with the lower surface of said intermediate member (24), foot means (31) attached to the lower ends of said legs extending outwardly from said leg members (12, 13), said foot means each having a surface flush with the outer surface of said sheets and a lever (25) pivoted to said cross member (24) and swingable to underlie said foot means for locking said legs in folded position.

* * * * *